United States Patent [19]

Greve et al.

[11] 4,313,974

[45] Feb. 2, 1982

[54] METHOD OF APPLYING ATOMIZED LIQUID PLASTICIZER TO A RUNNING TOW OF FILAMENTARY FILTER MATERIAL

[75] Inventors: Heinz Greve, Hamburg; Günter Wahle, Reinbek, both of Fed. Rep. of Germany

[73] Assignee: Hauni-Werke Körber & Co. KG., Hamburg, Fed. Rep. of Germany

[21] Appl. No.: 143,184

[22] Filed: Apr. 24, 1980

Related U.S. Application Data

[62] Division of Ser. No. 25,040, Mar. 29, 1979, abandoned.

[30] Foreign Application Priority Data

Apr. 5, 1978 [DE] Fed. Rep. of Germany ..... 2814881

[51] Int. Cl.[3] ..... B05D 1/02

[52] U.S. Cl. ..... 427/209; 118/316; 118/325; 118/326; 427/421; 427/424

[58] Field of Search ..... 118/316, 325, 326; 427/421, 209, 424

[56] References Cited

U.S. PATENT DOCUMENTS

| | | | |
|---|---|---|---|
| 3,172,777 | 3/1965 | Pano et al. | 118/316 X |
| 3,387,992 | 6/1968 | Arthur et al. | 118/325 X |
| 3,591,450 | 7/1971 | Murphy et al. | 118/316 X |
| 3,594,228 | 7/1971 | Mock | 118/326 X |
| 3,741,846 | 6/1973 | Greve | 118/325 X |
| 4,040,385 | 8/1977 | Tost | 118/326 |
| 4,132,189 | 1/1979 | Greve et al. | 118/326 X |

FOREIGN PATENT DOCUMENTS 1392063 4/1975 United Kingdom .

*Primary Examiner*—Shrive P. Beck

*Attorney, Agent, or Firm*—Peter K. Kontler

[57] ABSTRACT

A spread out foraminous tow of tensioned filamentary filter material is transported through a housing between an upper and a lower rotating cylindrical brush. The upper brush propels atomized liquid plasticizer against the upper side of the tow whereby a certain amount of plasticizer penetrates through the tow and is gathered in the housing within the range of bristles on the lower brush which propels the gathered plasticizer against the underside of the tow. The rate of feed of plasticizer to the upper brush is varied in response to changes in the speed of the tow, and the brushes are arrested when the transporting rolls for the tow are brought to a standstill. The lower portion of the housing constitutes a trough which surrounds the lower half of the lower brush and from which the gathered plasticizer is evacuated when the brushes are idle.

6 Claims, 2 Drawing Figures

METHOD OF APPLYING ATOMIZED LIQUID PLASTICIZER TO A RUNNING TOW OF FILAMENTARY FILTER MATERIAL

This is a division of application Ser. No. 025,040, filed Mar. 29, 1979, and now abandoned.

BACKGROUND OF THE INVENTION

The present invention relates to distribution of liquid droplets on a layer of filamentary material, and more particularly to improvements in a method of applying liquid plasticizer to a running tow of filamentary material, especially filamentary filter material which can be used for the manufacture of filter mouthpieces for cigarettes, cigars or cigarillos. Still more particularly, the invention relates to improvements in a method of applying minute droplets of atomized liquid plasticizer (such as triacetin) on a spread out layer or tow of filaments which may constitute cellulose acetate fibers of the type often employed in the manufacture of fillers for filter rod sections which are thereupon subdivided into filter mouthpieces of desired length.

It is already known to propel finely atomized liquid plasticizer against one side of a running tow of filamentary filter material. For example, U.S. Pat. No. 3,387,992 granted June 11, 1968 to Arthur et al. discloses a process and apparatus for propelling droplets of liquid plasticizer against the underside of a running tow of filamentary material by resorting to a hollow disc having several peripheral outlets. Liquid plasticizer is fed into the disc and is propelled through the outlets and against the running tow under the action of centrifugal force. The droplets which penetrate through the normally permeable spread out tow descend onto the upper side of the tow by gravity. The patent to Arthur et al. further discloses the possibility of using two hollow discs, one at each side of the running tow, when the tow is relatively dense or is non-porous or impervious to such an extent as to prevent droplets issuing from a single disc from passing through the material of the tow. Neither of the two proposals insures satisfactory (uniform) application of platicizer, i.e., such application that each and every increment or unit length of the running tow retains a fixed quantity of atomized plasticizer.

Commonly owned British Pat. No. 1,392,063 discloses a modified apparatus wherein a nozzle sprays liquid plasticizer against one side of the running tow and the other side of the tow slides along a stationary plate so that all droplets which penetrate through the tow are intercepted by the plate and are swept away by the filaments of the tow. Such apparatus insures more satisfactory distribution of plasticizer in successive unit lengths of the tow; however, its application in filter rod making or like machines is limited due to the fact that certain types of filamentary material cannot withstand continuous rubbing against a stationary surface.

OBJECTS AND SUMMARY OF THE INVENTION

An object of the invention is to provide a novel and improved method which insures uniform or practically uniform application of atomized liquid plasticizer to successive unit lengths of a running tow of filamentary material.

Another object of the invention is to provide a method according to which uniform application of atomized plasticizer to successive unit lengths of the running tow is insured in spite of the fact that the filaments of the tow need not rub against a stationary surface.

A further object of the invention is to provide a method of uniformly applying liquid plasticizer to successive unit lengths of a running tow even if the speed of the tow varies within a rather wide range.

An additional object of the invention is to provide a method which insures that portions of filaments in a running tow are plasticized without any or with negligible waste in the material of the plasticizer.

The invention resides in the provision of a method of applying droplets of liquid plasticizing to successive increments of a running foraminous tow of filamentary material. The method comprises the steps of transporting the tow lengthwise along a predetermined path (e.g., along a substantially horizontal path), propelling droplets of liquid plasticizer against successive increments of the running tow at one side of the path (preferably at the upper side if the path is substantially horizontal) whereby certain droplets adhere to the filamentary material and the remaining propelled droplets penetrate through the foraminous tow to the other side of the path, and propelling at least some of such remaining droplets against successive increments of the running tow at the other side of the path.

If the transporting step comprises conveying the tow at a variable speed, the method preferably further comprises the steps of varying the quantity of plasticizer which is propelled against the running tow at the one side of the path as a function of variations of the speed of the row so that the quantity of plasticizer which is propelled against successive unit lengths of the tow at the one side of the path remains at least substantially constant.

The method preferably further comprises the steps of interrupting the propulsion of droplets against the tow at both sides of the path in automatic response to interruption of the transporting step.

The method preferably also includes the steps of supplying liquid plasticizer to the one side of the path in the form of at least one continuous stream and atomizing successive increments of the stream or streams in the course of the first propelling step. Such atomizing can be achieved by resorting to a rotary brush which is installed at the one side of the path and whose bristles atomize successive increments of the stream or streams and propel the droplets of atomized plasticizer against the running tow. A similar brush can be utilized at the other side of the path to propel some or all of the remaining droplets (i.e., at least some of those droplets which have penetrated through the foraminous tow) against the tow at the other side of the path.

The apparatus which can be used for the practice of the above outlined method preferably comprises a housing which intercepts the remaining droplets of liquid plasticizer at the other side of the path and directs the gathered droplets into the range of bristles on the respective brush.

The transporting step preferably includes stretching the filamentary material in the longitudinal direction of the tow. This can be achieved by installing the plasticizer applying apparatus between two pairs of advancing rolls which are driven at different peripheral speeds so that the filaments of the tow are under tension during travel between the two brushes.

The novel features which are considered as characteristic of the invention are set forth in particular in the appended claims. The apparatus itself, however, both as to its construction and its mode of operation, together with additional features and advantages the improved method, will be best understood upon perusal of the following detailed description of certain specific embodiments with reference to the accompanying drawing.

DESCRIPTION OF THE PREFERRED EMBODIMENTS

Figures 1, 2:
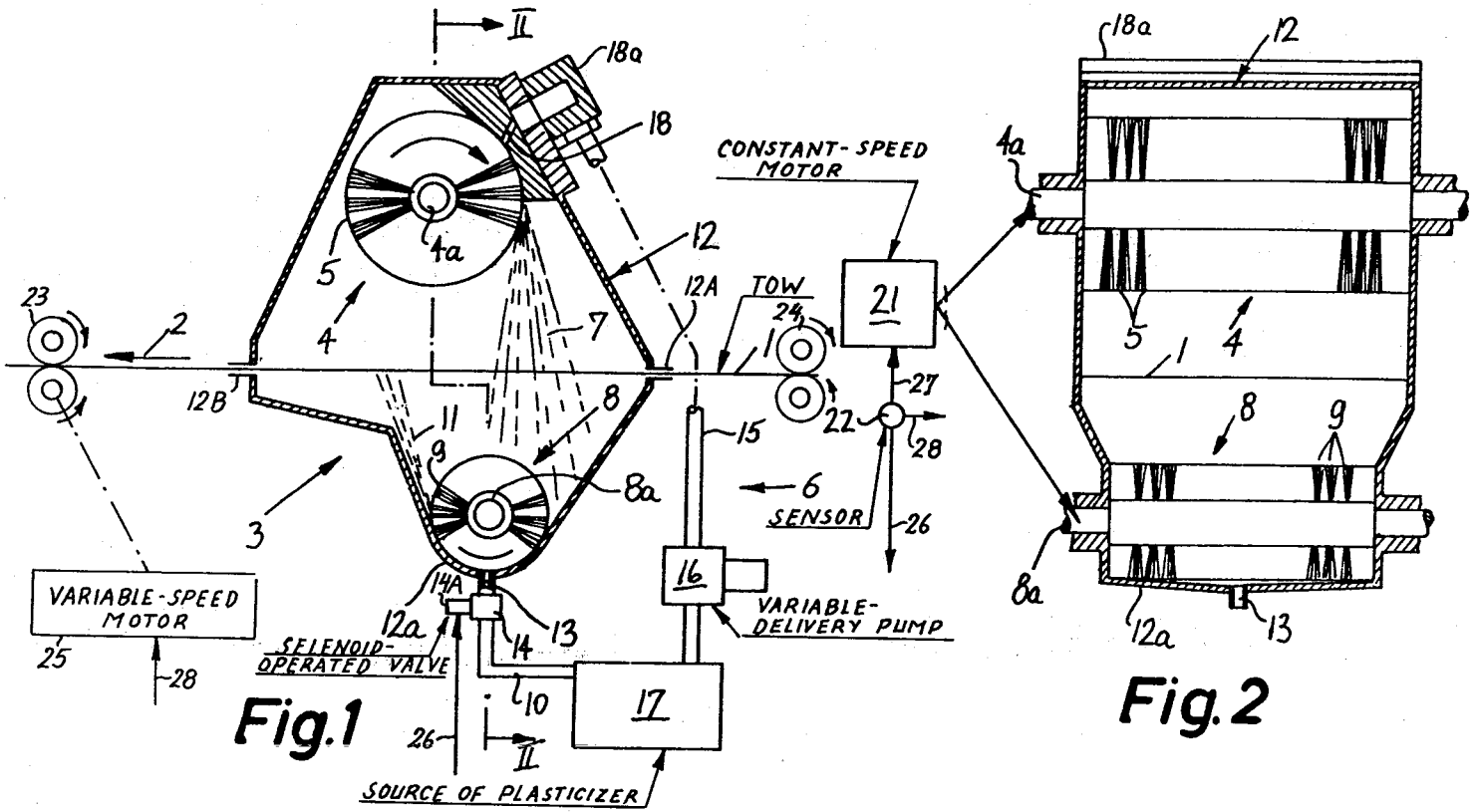
FIG. 1 is a partly diagrammatic and partly central longitudinal vertical sectional view of an apparatus which can be used for the practice of the method.
FIG. 2 is a transverse vertical sectional view as seen in the direction of arrows from the line II—II of FIG. 1.

The apparatus which is shown in FIG. 1 is installed in a filter rod making machine, e.g., a machine of the type disclosed in the aforementioned British Pat. No. 1,392,063 or in the corresponding U.S. Pat. No. 4,132,189 granted Jan. 2, 1979 to Heinz Greve et al. The tow 1 is withdrawn from a bale and is caused to pass through one or more banding devices which spread out the tow to convert the latter into a wide foraminous layer of relatively movable filaments. The means for transporting the tow 1 lengthwise comprises several sets of driven-rolls including the rolls 23 and 24 which are shown in FIG. 1 and define an elongated horizontal or nearly horizontal path along which the layer or tow 1 is advanced in the direction of arrow 2. The peripheral speed of the front rolls 23 exceeds the peripheral speed of the rear rolls 24 so that the filaments (e.g., acetate fibers) of the tow 1 are stretched in the longitudinal direction of the tow and may be nearly or exactly parallel to each other, depending on the difference between the peripheral speed of the rolls 23 and 24.

The apparatus further comprises a housing 12 which is disposed between the rolls 23, 24 and has an inlet opening 12A for admission of successive increments of the running tow 1 and an aligned outlet opening 12B where the tow leaves the housing on its way toward the nip of the transporting rolls 23. The housing 12 is installed at a plasticizer applying station 3 and confines a first or upper propelling device 4 which is a cylindrical brush having a horizontal drive shaft **4*a* and a set of radially outwardly extending flexible bristles 5. The housing 12 further accommodates a second or lower propelling device 8 which is a cylindrical brush having a horizontal drive shaft 8*a* and a set of radially outwardly extending flexible bristles 9**.

The means 6 for supplying a stream of liquid plasticizer (e.g., triacetin) into the range of the bristles 5 from a vessel 17 or another suitable source comprises a conduit 15 which contains a pump 16 and admits successive increments of the liquid stream into a manifold **18*a* secured to or made integral with the upper portion of the housing 12. The stream which is admitted via conduit 15 is divided into several smaller streamlets which flow through the bores or ports 18 (only one shown) of the manifold 18*a* and are atomized by the tips of the orbiting bristles 5. The bores 18 can be replaced with an elongated slit which extends in parallelism with the axis of the brush 4 to insure uniform distribution of liquid plasticizer to all of the bristles 5. The droplets 7 of atomized plasticizer are propelled against the upper sides of successive increments of the spread out tow 1 in the housing 12 whereby certain droplets adhere to the filaments and the remaining droplets pass through the foraminous tow to be intercepted and gathered in the lower part of the housing 12. The gathered droplets flow into a trough-shaped lower end portion 12*a* of the housing 12. The portion 12*a* surrounds the lower half of the brush 8, and the gathered body of liquid plasticizer is atomized by the bristles 9 which propel droplets 11 of plasticizer against successive increments of the running tow 1 at the underside of the elongated path which extends between the openings 12A and 12B. The action of the banding device or devices (shown at 7 and 8 in FIG. 1 of the aforementioned British Pat. No. 1,392,063) is such that, as a rule, the permeability of the spread out tow 1 invariably suffices to enable a certain percentage of droplets 7 to penetrate through the running tow and to accumulate in the lower part of the housing 12. The likelihood of penetration of some droplets 7 through the tow 1 is especially pronounced when the banding action is not entirely uniform, i.e., when relatively dense longitudinally extending strip-shaped portions or streaks of the tow alternate with thinner and hence more porous strip-shaped portions. It has been found that the provision of the second propelling device (brush 8) opposite the brush 4 contributes significantly to uniformity of the plasticizing action, i.e., the quantity of liquid plasticizer which is applied to successive unit lengths of the running tow is uniform or practically uniform. Furthermore, the filaments of the tow 1 need not rub against one or more stationary surfaces because the width of the openings 12A and 12B can be readily selected in such a way that the filaments need not contact the housing 12 during travel toward or away from the space between the rotating brushes 4 and 8**.

The walls of the lower part of the housing 12 slope toward the trough-shaped lower end portion **12*a* so that the latter collects all droplets 7 which have penetrated through the tow 1 and maintains the thus accumulated recovered body of liquid plasticizer in the range of the orbiting bristles 9. In normal operation, the brush 8 can atomize all of the liquid which accumulates in the lower end portion 12*a* of the housing 12. Moreover, the gathered body of liquid plasticizer is atomized practically without delay and the atomized particles or droplets 11 are propelled against the undersides of successive increments of the tow 1 to insure a more uniform plasticizing action. Those droplets 11 which fail to adhere to the filaments of the running tow 1 descend into the lower end portion 12*a* or are entrained by the ascending droplets 11**.

The lowermost part of the end portion **12*a* has an outlet 13 which is normally sealed by an adjustable closing device 14, preferably a solenoid-operated valve which can be caused to close when the drive shafts 4*a*, 8*a* begin to rotate the respective brushes and to open in automatic response to stoppage of the shafts 4*a* and 8*a*, i.e., as soon as the propelling action of the brushes 4 and 8 is interrupted or terminated. This prevents stagnation of gathered liquid plasticizer in the trough-shaped portion 12*a* of the housing 12. When the valve 14 is open, the outlet 13 admits liquid plasticizer into a conduit 10 which returns the liquid into the source 17**.

The pump 16 is preferably a variable-delivery pump adapted to cause a stream of liquid plasticizer to flow into the manifold **18*a* at a rate which is a function of the speed of lengthwise movement of the tow 1. This insures that each unit length of the tow 1 receives the same quantity of atomized plasticizer regardless of whether the speed of lengthwise movement of the tow (arrow 2) is increased or reduced. For example, the pump 16 can derive motion from a variable-speed prime mover 25 (e.g., a DC-motor) for the transporting rolls 23 and 25. If the pump 16 is driven by a separate variable-speed motor, the speed of the motor 25 is monitored by a tachometer generator which transmits appropriate signals to the amplifier for the discrete pump motor. Synchronization of the rate of delivery of liquid plasticizer to the manifold 18***a* with the speed of the tow 1 insures that the quantity of plasticizer which is applied per unit length of the tow 1 does not change when the tow is accelerated or decelerated, for example, when a monitoring device ascertains that the resistance which the filler of the filter rod offers to axial flow of a gas therethrough deviates from a desired value.

FIG. 2 shows a prime mover 21 which transmits torque to the drive shafts 4*a* and 8*a* of the brushes 4 and 8. It is preferred to employ a prime mover 21 which is a constant-speed motor. The motor 21 is automatically arrested in response to stoppage of the tow 1. To this end, the apparatus comprises a sensor 22 which is associated with the transporting rolls 23 or 24 or with the motor 25 and transmits a signal to arrest the motor 21 as soon as the lengthwise movement of the tow 1 is terminated. The sensor 22 can also monitor the tow 1 to transmit a signal when the tow is arrested. Furthermore, the sensor 22 transmits signals to the circuit of the solenoid 14*a* of the valve (via conductor means 26) to open the valve 14 when the motor 21 is arrested. Still further, the element 22 may constitute a two-position switch which is in circuit with the motor 25 and solenoid 14*a*. In one of its positions, the switch completes the circuit of the motor 25 and deenergizes the solenoid 14*a* so that the valve 14 closes and prevents the flow of liquid plasticizer from the trough-shaped lower end portion 12*a* of the housing 12 into the vessel 17. In the other position of the switch, the valve 14 is open and the motor 25 is arrested. The conductor means 27 denotes the operative connection between the monitoring element 22 and the motor 21, and the conductor means 28 denotes the operative connection between the element 22 and the motor 25.

An advantage of the outlet 13, valve 14 and conduit 10 is that the lower end portion 12*a* of the housing 12 cannot accumulate a relatively large body of liquid plasticizer while the brush 8 is idle. In the absence of the valve 14, the bristles 9 of the brush 8 would abruptly propel a large quantity of atomized plasticizer against the underside of the tow 1 in immediate response to renewed starting of the motor 21. The valve 14 closes automatically as soon as the motors 21 and 25 are started, i.e., as soon as the tow 1 begins to move lengthwise.

Stoppage of the brushes 4 and 8 in immediate response to interruption of lengthwise movement of the tow 1 is desirable and advantageous because excessive accumulations of plasticizer in certain portions of the tow 1 could interfere with proper operation of the filter rod making machine.

Without further analysis, the foregoing will so fully reveal the gist of the present invention that others can, by applying current knowledge, readilly adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. A method of applying droplets of liquid plasticizer to successive increments of a foraminous tow of filamentary filter material, comprising the steps of transporting the tow lengthwise along a predetermined path; establishing and maintaining a source of liquid plasticizer; conveying liquid plasticizer from said source solely to one side of said path; propelling droplets of the conveyed liquid plasticizer against successive increments of the running tow at said one side of said path whereby certain droplets adhere to the filamentary material and the remaining droplets penetrate through the foraminous tow to the other side of said path; intercepting the remaining droplets at the other side of said path; propelling, exclusively, at least some of the intercepted remaining droplets against successive increments of the running tow at said other side of said path so that all droplets which are propelled against the running tow at said other side of said path consist only of plasticizer which has penetrated through the running tow from said one side of said path; and atomizing, in the course of said last named propelling step, the droplets which are propelled against the running tow at said other side of said path.

2. The method of claim 1, wherein said transporting step comprises conveying the tow at a variable speed, and further comprising the step of varying the quantity of plasticizer which is propelled against the running tow at said one side of said path as a function of variations of said speed.

3. The method of claim 1, further comprising the steps of interrupting said transporting step and simultaneously interrupting said propelling steps.

4. The method of claim 1, wherein said path is substantially horizontal and said one side is the upper side of said path.

5. The method of claim 1, wherein said conveying step includes supplying liquid plasticizer to said one side of said path in the form of at least one continuous stream and atomizing said stream in the course of said first named propelling step.

6. The method of claim 1, wherein said transporting step includes stretching the filamentary material of the tow in the longitudinal direction of said path.

* * * * *

UNITED STATES PATENT AND TRADEMARK OFFICE

CERTIFICATE OF CORRECTION

PATENT NO. : 4,313,974

DATED : February 2, 1982

INVENTOR(S) : Heinz GREVE, Günter WAHLE

It is certified that error appears in the above-identified patent and that said Letters Patent are hereby corrected as shown below:

Foremost page, Item [30], Serial No. should be --2814681--.
Col. 1, line 43, "platicizer" should read --plasticizer--.
Col. 2, line 12, "plasticizing" should read --plasticizer--.
Col. 3, line 2, insert --of-- after "advantages".
Col. 6, line 5, "readilly" should read --readily--.

Signed and Sealed this

*Tenth* Day of *May 1983*

[SEAL]

*Attest:*

GERALD J. MOSSINGHOFF

*Attesting Officer* *Commissioner of Patents and Trademarks*